United States Patent [19]

Tanaka

[11] 4,287,612

[45] Sep. 8, 1981

[54] METHOD OF MAKING AND ORNAMENTING SHIRTS AND SHORTS

[76] Inventor: Minoru Tanaka, 419-banchi Hatanosho Taharamotomachi, Shiki-gun Nara-pref., Japan

[21] Appl. No.: 37,369

[22] Filed: May 9, 1979

[30] Foreign Application Priority Data

Jul. 19, 1978 [JP] Japan ..... 53-88848
Aug. 18, 1978 [JP] Japan ..... 53-101031

[51] Int. Cl.[3] ..... A41D 17/02
[52] U.S. Cl. ..... 2/243 R
[58] Field of Search ..... 2/243 R, 243 B; 66/176

[56] References Cited

U.S. PATENT DOCUMENTS

| | | | |
|---|---|---|---|
| 826,683 | 7/1906 | McDonald | 2/243 R |
| 1,342,010 | 6/1920 | Weis | 2/243 R |
| 1,831,192 | 11/1931 | Persky | 2/243 B |
| 2,049,966 | 8/1936 | Lerner | 2/243 R |
| 3,820,165 | 6/1974 | Negherbon | 2/243 R |

FOREIGN PATENT DOCUMENTS

| | | | |
|---|---|---|---|
| 1212617 | 10/1959 | France | 2/402 |

*Primary Examiner*—Doris L. Troutman
*Attorney, Agent, or Firm*—Fisher, Christen & Sabol

[57] ABSTRACT

A method of making body garments, such as shorts or shirts which have decorations applied along their sides, includes starting with a length of tubular material which is flattened for passing it through a design-applying mechanism which applies decorations along the central area, cutting off pairs of identical garments along transverse lines spaced from each other a distance sufficient to provide two garments between them, these transverse lines defining the respective waist lines; removing pieces of material midway between the transverse lines to provide openings for the legs in the case of shorts, and for the neck and arms in the case of shirts. The tubular material is then shifted to place the decorated areas to the sides and the garments are finished by either joining portions of the margins together, or by joining the margins with additional material.

11 Claims, 15 Drawing Figures

FIG 3
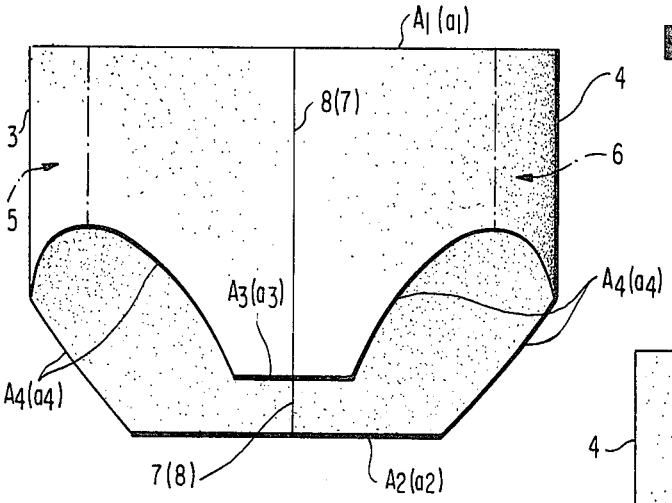
FIG 4
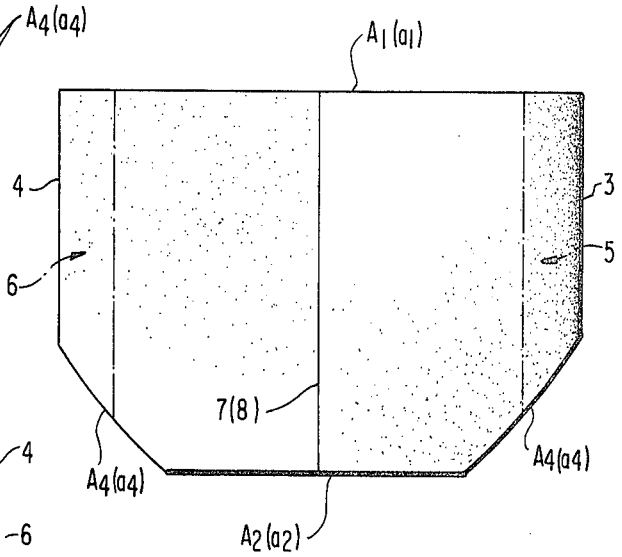
FIG 5
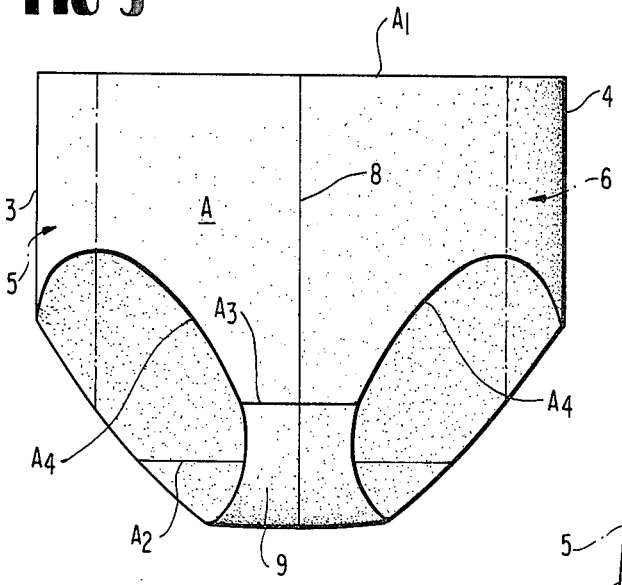
FIG 6
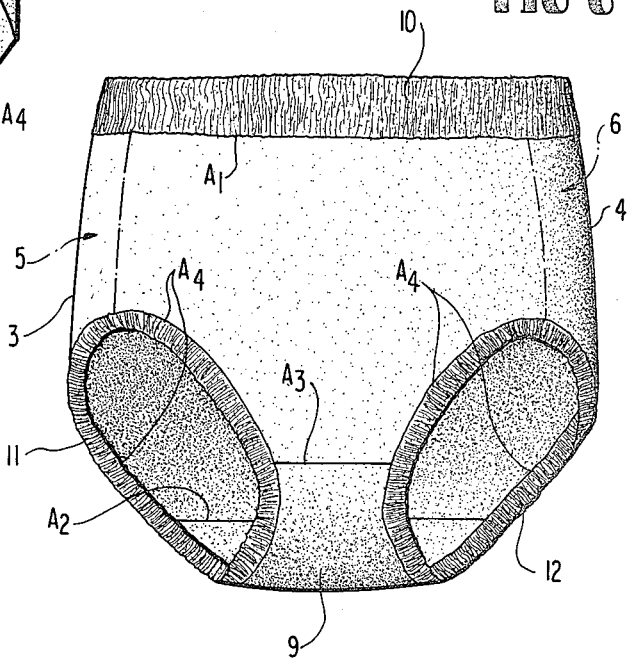
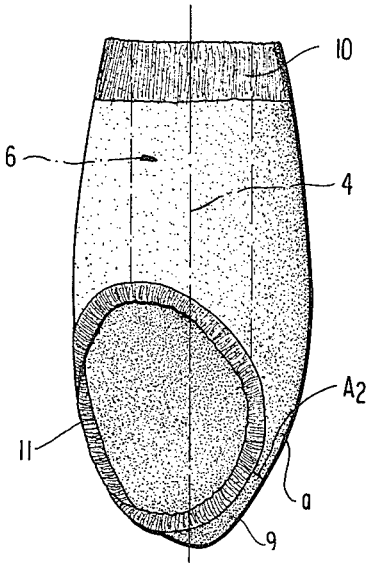
FIG 7

FIG 8
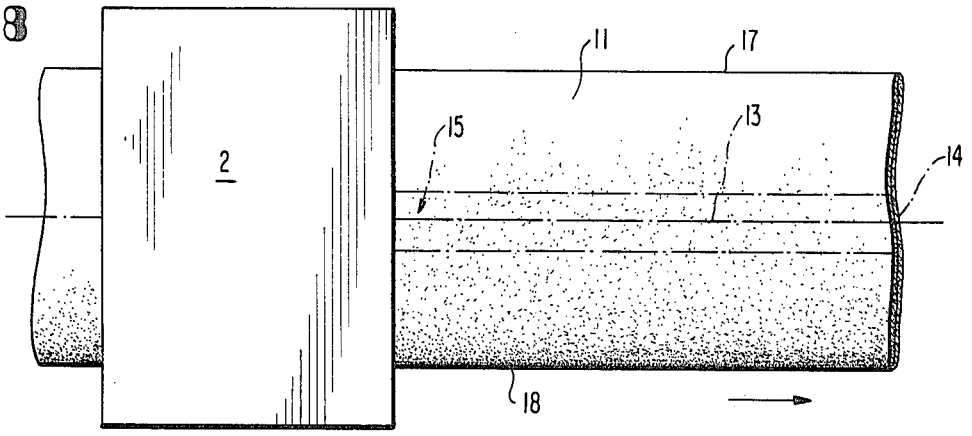
FIG 9
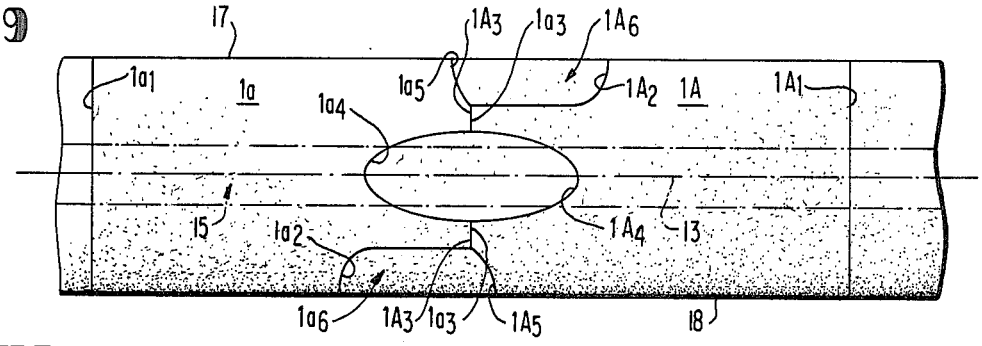
FIG 10
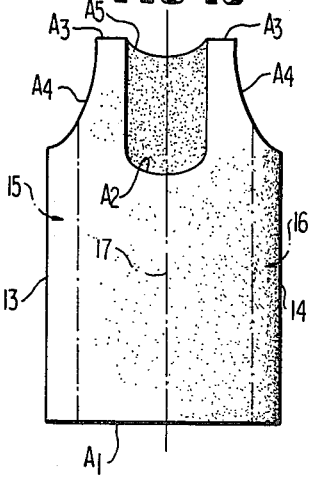
FIG 11
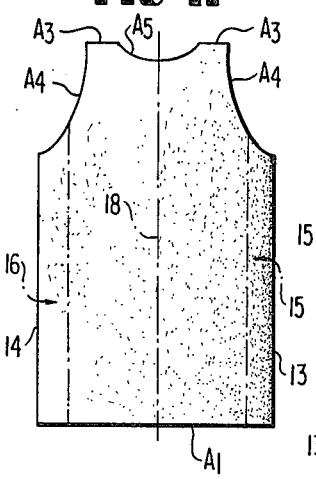
FIG 13
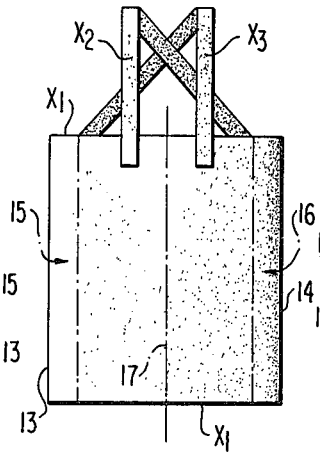
FIG 14
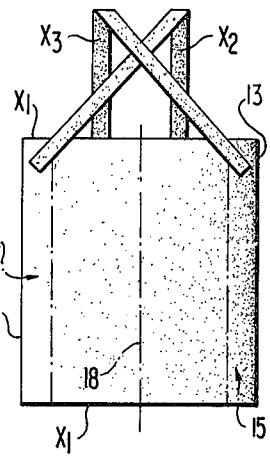
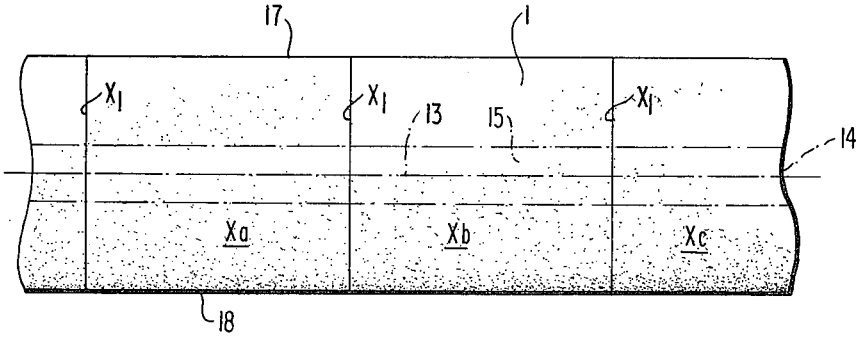
FIG 12

METHOD OF MAKING AND ORNAMENTING SHIRTS AND SHORTS

BACKGROUND OF THE INVENTION

This invention relates to the mass production of articles of clothing, particularly shorts, or panties, and shirts of the type called T-shirts, or tank tops.

In making these garments it is often desireable to apply ornamentation, such as a pattern, or design, in the area extending longitudinally along one, or both, sides of the garments. In the case of articles of clothing of the above-mentioned types it is difficult to apply these patterns during production of the garments in such a way that they will be properly located in the completed garments.

SUMMARY OF THE INVENTION

The present invention accomplishes the desired results by forming garments, such as shorts and shirts for a continuous band of tubular fabric, which may be a seamless tubular material, or may comprise one, or more, lengths of material joined at the longitudinal margins to form a continuous fabric tube.

This tube of fabric is then laid out flat as it is passed through an appropriate patterning, or design-applying, apparatus, the tube being laid out so that the longitudinal center lines of the two superposed plies of material define the respective side margins of the garments when finished. In this fashion it is a simple matter to orient the ultimate location of the ornamentation to be applied, since the center lines at that stage represent the sides of the finished goods.

After the designs have been applied, or even if there is no patterning to be applied, the tubular material is severed along transverse lines which define the material required for a single pair of identical garments, whether they be a pair of shorts, or a pair of shirts. These transverse lines define what may be called the respective waist lines of the two garments; the term "waist line" being used, to define the upper margins of a pair of shorts, or the lower margins of a pair of shirts, it being obvious that in the case of both types of garments these margins sometimes fall considerably below the natural waist line of the wearer.

To complete the cutting of the garments identical but irregularly shaped pieces of material from each ply are cut out, or otherwise removed, at the location midway between the first two transverse severance lines and the two portions of tubular material are severed from each at this point. The shapes of the portions of removed material are such that the curved margins remaining will define openings for the extremities of the user's body which are remote from the waist, namely, the legs in the case of a pair of shorts and the head and arms in case of a shirt.

However, with the tubular material being laid out with the side margins arranged in the center, the cut out portions will correspond to the profiles of these openings as viewed from the side, rather the front, the two remaining pieces of tubular material being mirror images of each other. To complete the respective garments, in the case of shorts, an additional piece of material forming the crotch is joined to the front and back extremities of material remaining while, in the case of shirts the front and back pairs of extremities are joined to each other.

Other objects and advantages of the invention will be apparent to those skilled in the art after reading the following specification in connection with the amended drawing.

BRIEF DESCRIPTION OF THE DRAWINGS

FIG. 3 is a front view of the previously cut material when rearranged to attach the crotch portion;

FIG. 4 is a rear view of FIG. 3;

FIG. 5 shows the crotch portion when attached;

FIGS. 6 and 7 are respectively, front and side views of a completed article with elastic waist band and legs;

FIG. 8 is a plan view of folded tubular material to be made into shirts as it comes from a design applying machine;

FIG. 9 is a view of the material cut in a pattern to make pairs of shirts;

FIGS. 10 and 11 are respectively front and back views of the completed articles;

FIG. 12 is a plan view of the folded material after cutting in a pattern to make another type of shirt, and;

FIGS. 13 and 14 are, respectively, front and back views of the modified forms of shirt.

DESCRIPTION OF THE PREFERRED EMBODIMENT

Figure 1:
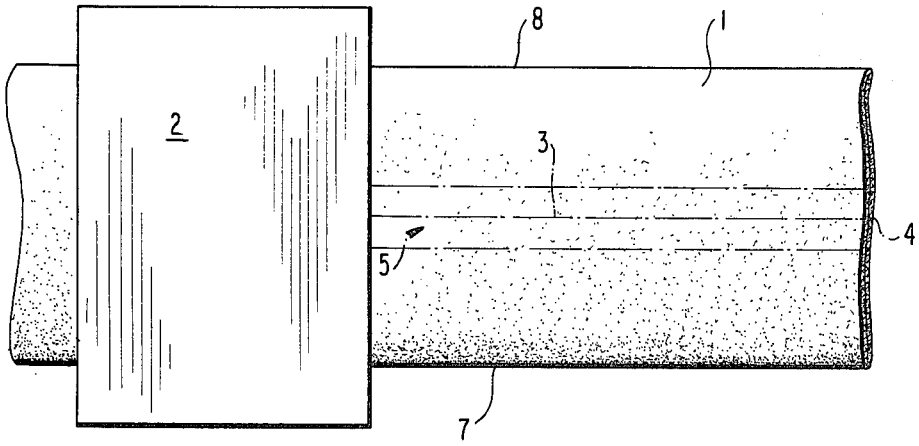
FIG. 1 is a plan view of the starting material comprising a length of flat folded tubular material as it passes through a design applying machine.

As shown in FIG. 1, a length of tubular fabric material, indicated by numeral 1, is flattened out to provide upper and lower superimposed plies of the material, the longitudinal center lines of these plies being denoted by numerals 3 and 4. The flattened tubular fabric is first passed through a printing machine 2, or other type of design-applying apparatus, moving from left to right and receiving appropriate designs, indicated by numerals 5 and 6, to the exposed surface of the upper or lower ply, or to the surfaces of both plies.

Figure 2:
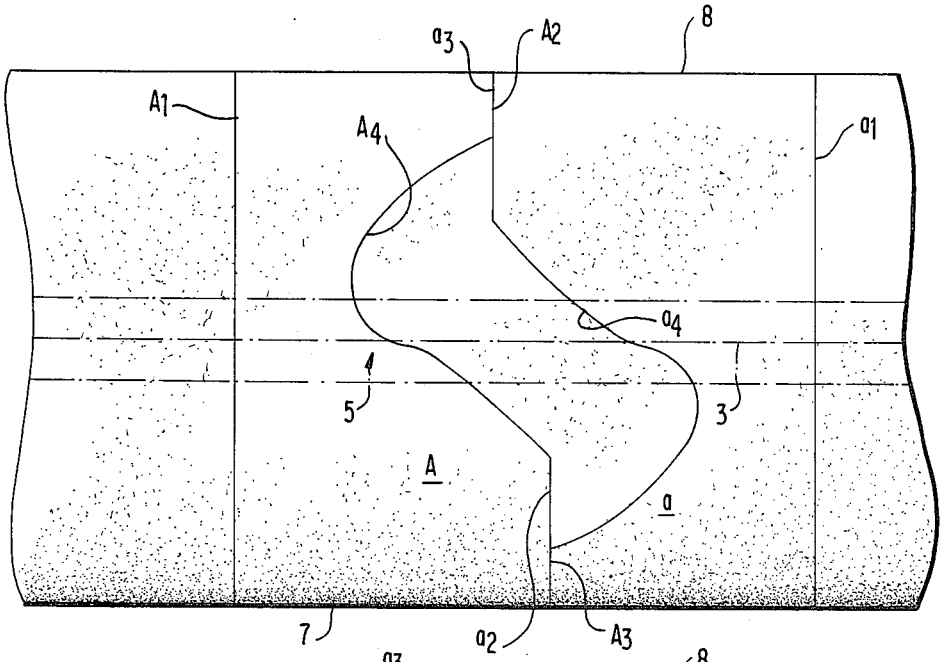
FIG. 2 is a view of the material after being cut in a pattern to produce pairs of shorts.

After this, as shown in FIG. 2, the tubular material is cut according to a pattern which forms a pair of similar, but oppositely facing shorts, or panties, denoted by A and a. Similar pairs of articles are successively cut from as much of the length of material as is available. Each pair of articles is defined by the transverse cutting lines $A_1$ and $a_1$, each of which lines will define the waist line of a single one of the articles. Successive pairs of shirts are cut out along the length of the tubular material 1.

In the areas midway between the transverse line $A_1$ and $a_1$, portions of material are cut out from the two plies of material to form the lower margins of the articles. The pattern is identical for each ply and the lower back margins for the respective articles are formed by longitudinally offset inwardly directed cuts made along transverse lines $A_2$ and $a_2$. These same cuts will also form the respective lower from margins $A_3$ and $a_3$ of the articles. The respective outer contours of the leg portions are defined as the fabric is cut along the irregular lines $A_4$ and $a_4$.

Figure 2A:
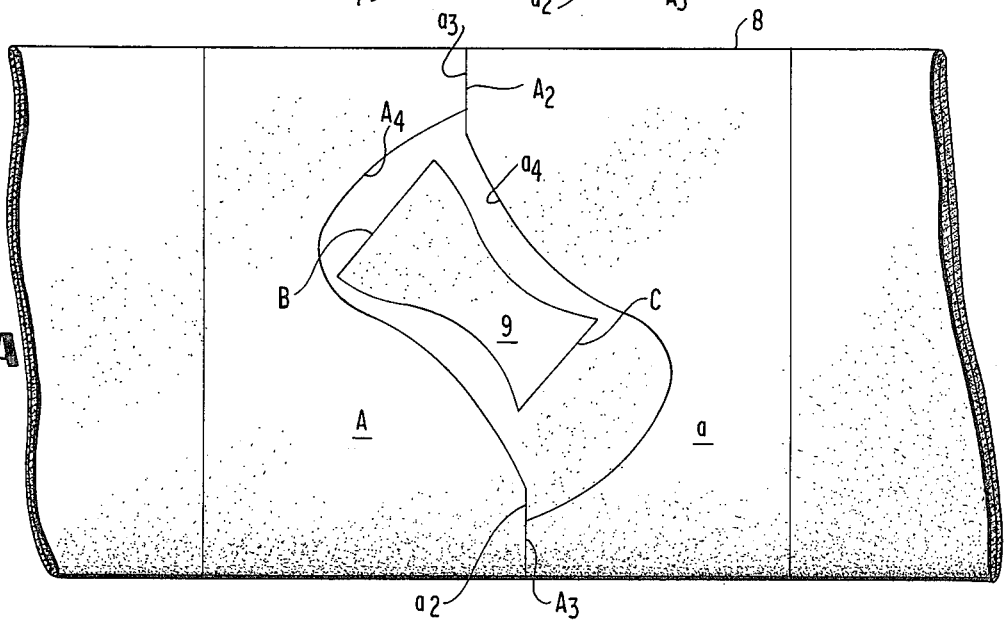
FIG. 2A shows an alternative cutting pattern.

As a result of the foregoing an irregular portion of material is removed from the area between the lines $A_4$ and $a_4$ and as shown in FIG. 2A, the generally hourglass-shaped portions of material 9 can be removed from the two plies of this material. These two plies of material will ultimately form the crotch portion of the undershorts and, if desired can be supplied some other source of material.

When the two tubular pieces of material A and a have been separated from each other and rearranged as shown in FIGS. 3 and 4, it will be seen that the resulting articles $A_1$ ($a_1$), lower front margins $A_2$ ($a_2$) and lower back margins $A_3$ ($a_3$). What were the original center lines 3 and 4 have now become the respective side margins upon which the applied designs 5 and 6 now appear. The outer margins for the leg openings at each side of one of the pairs of garments are defined by the curved lines indicated at $A_4$ in FIG. 2 and similarly the outer leg openings in the other garment are defined by the curved lines $a_4$. This is so because when the tubular material was laid out in FIG. 2 there were two outer leg openings formed along each of the lines $A_4$ and $a_4$.

Each of the crotch portions 9 are now attached to each of shorts A and a by attached, as by sewing, the wide end margins B to the respective lower back margins $A_2$ and $a_2$ and the narrow end margins C to the respective lower front margins $A_3$ and $a_3$, as shown in FIG. 5.

To complete each garment an elastic band 10 may be attached at the waistline and, if desired, the elastic bands 11 and 12 may be attached around the respective leg openings of each garment, as shown in FIG. 6.

It will thus be seen that by this process it is possible to form successive pairs of shorts or panties, from a continuous length of tubular fabric, each of the pairs of garments being defined by a pair of generally straight transverse cutting lines and a pair of irregularly curved transverse lines about midway between the first two lines, resulting in the formation of two inversely related substantially identical garments whose ultimate side margins are at that point disposed along the longitudinal center line of the flattened tubular material.

By the same token this method makes it possible to apply a design, or pattern, along the central length of both surfaces of the flattened tube prior to cutting so that this pattern will appear along the side margins of the pattern fabric in FIG. 1, and a black colored pattern is applied to the lower surface, the finished shorts will have the red pattern at the right side and the black pattern at the left side.

Another embodiment of the invention, in which shirts are produced from tubular material is shown in FIGS. 8–11. As in the first embodiment, a length of tubular fabric, indicated by numeral 11, is passed through a printing, or design-applying machine 2 which places patterns 15 and 16 to the central areas of the respective exposed surfaces of the two plies of flattened tubular material 11, the respective center lies of which are indicated by numerals 13 and 14.

Then, as shown in FIG. 9, succeeding pairs of shirt blanks 1A and 1*a* are produced by cutting the tubular material at spaced intervals along the transverse severance lines $\mathbf{1}A_1$ and $\mathbf{1}a_1$. The resulting end margins of the severed material will define the waistlines of two oppositely facing shirts.

Also the tubular material is cut at its midpoint along a series of lines which form the front and back necklines and the arm holes for both garments. For example the curved line $\mathbf{1}A_2$ will define the front neckline of the shirt to be made from the tubular blank 1A, while the curved line $\mathbf{1}a_2$ will define the front neckline of blank $\mathbf{1}a_2$. In the case of the oval portion of material removed by cutting along the facing curved lines $\mathbf{1}A_4$ and $\mathbf{1}a_4$, the margins of the material remaining will define both of the arm holes in both garments since, in each case, these lines of severance are made along the center lines 13 and 14 which lie at the sides of the finished articles and both plies of the tubular material have been cut with identical patterns. To complete the arm holes, two more transverse cuts are made in the material between the arm holes and the front and back neck lines, represented by the coincident lines $\mathbf{1}A_3$ and $\mathbf{1}a_3$ on opposite sides of the center lines 13 and 14. Thereafter the lines $\mathbf{1}A_3$ on opposite sides of the tubular material 11 in FIG. 9 define upper margins of the shoulder portions which will be joined together, as by sewing, to complete the arm holes for the garment made from tubular material 1A as shown in FIGS. 10 and 11. Similarly, the lines $\mathbf{1}a_3$ in FIG. 9 indicate upper shoulder margins to be joined together to form the arm holes for the companion garment 1*a* (not shown).

It should also be observed that the completion of the articles is accomplished to shifting the relative position of the upper and lower layers of fabric so the side margins 17 and 18 of FIG. 9 will, in FIGS. 10 and 11, define the front and back center lines of the completed shirts, while the designs placed along the center lines 13 and 14 of FIG. 9 are finally located at the sides of the clothing shown in FIGS. 10 and 11.

For example, if a red colored design has been applied to upper fabric surface and a white colored design to the lower surface, of the tubular material in FIG. 9, they appear on the right and left sides of the finished articles of clothing as shown in FIGS. 10 and 11.

Another type of shirt made in accordance with the process of this invention is shown in FIGS. 12–14. The starting material is the same tubular fabric 1, used in the previous embodiment, which is first passed through a design applying machine to apply decorator patterns along the areas adjacent the center lines 13 and 14. The tubular material is then cut along the parallel spaced transverse lines $X_1$ to form a series of tubular articles $X_a$, $X_b$, $X_c$ . . . .

The articles are then rearranged so that the decorated fabric along the previous center lines 13 and 14 are disposed at the sides, while the previous side margins 17 and 18 of FIG. 12 lie along the center front and back is illustrated in FIGS. 13 and 14, with the upper and lower margins being defined by the lines $X_1$ along which the articles $X_a$, $X_b$, $X_c$ . . . were severed from each other. Since these cutting lines are parallel it is apparent that either margin can be at the top or bottom. The shirts are completed by attaching the shoulder straps $X_2$ and $X_3$ to one of the margins. Obviously a single shoulder strap, in halter top fashion, could be used by attaching the ends to the upper front margin. This type of shirt is particularly suited for large scale efficient production.

I claim:

1. Method of producing body garments having a generally symmetrical profile when viewed from the front or back and a profile when viewed from the side which is assymmetrical comprising the steps of:

laying out a length of tubular material sufficient to make an even number of garments to provide two plies of said material collapsed into a flat plane in which the elongated center line of said collapsed material defines a vertical line disposed along the respective sides of the finished garment;

applying a design to the longitudinally extending central surface of said collapsed material, said design being intended to cover an area at the side of a finished garment;

severing said two plies of collapsed material transversely along two longitudinally spaced lines which define the waist lines of two oppositely disposed garments, and;

severing said two plies of collapsed material transversely at a location medial of said first two lines and removing superposed pieces of material having identical outlines from both of said plies to provide openings for the extremities of the body remote from the waist.

2. The method of claim 1, wherein the opening resulting from removing said pieces of material is disposed at the leg openings of a finished garment.

3. The method of claim 2, wherein the severing of the collapsed material at said medial location includes cutting the material inwardly from each of the side margins to form in each instance a lower front margin for one garment and a lower rear margin for the other garment, to which respective margins of each garment a crotch portion is attached to complete the garment.

4. The method of claim 3, wherein the material for the crotch portions is obtained from the pieces of material removed at said medial location.

5. The method of claim 1, wherein said pieces of material removed at said medial location provide openings in the remaining material which define the neck line and armholes in each of the two adjacent pieces of tubular material.

6. The method of claim 1, wherein the superposed pieces of removed material leave a central opening and material is removed from each margin to define recesses, said recesses being separated by a pair of narrow bands of material, and also includes the steps of;

severing said narrow bands along a transverse line, and;

joining the extremities of said narrow bands of each ply of material together to form the completed garments.

7. Method of producing body garments having a generally symmetrical profile when viewed from the front or back and a profile when viewed from the side which is assymmetrical comprising the steps of:

laying out a length of tubular material sufficient to make an even number of garments to provide two plies of said material collapsed into a flat plane in which the elongated center line of said collapsed material defines, a vertical line disposed along the respective sides of the finished garment;

severing said two plies of collapsed material transversely along two longitudinally spaced lines which define the waist lines of two oppositely disposed garments;

severing two superposed pieces of material having identical outlines from said two plies of material at a location midway between said longitudinally spaced lines and medial of the opposite side margins of the collapsed material to define the respective arm holes of the finished garment, and;

severing a single piece of material from each of the opposite margins of said two plies of material at positions adjacent said location midway between said longitudinally spaced lines, the lines of severing in one ply being identical with the lines of severing in the other ply to define the respective front and rear necklines of each garment.

8. The method of claim 7, wherein said two plies of material are severed along transverse lines extending between the line defining said identical outlines and the respective lines defining the material severed from the margins to separate the remaining material into two pieces.

9. The method of claim 8, wherein the positions at which material is severed from said margins are longitudinally offset with respect to said location midway between said longitudinally spaced lines whereby necklines of unequal depth are formed.

10. The method of claim 9, wherein the positions at which material is severed from said margins are also longitudinally offset with respect to each other, whereby each finished garment will have front and back necklines of unequal depth.

11. The method of any one of claims 7, 8, 9 or 10, which includes the step of applying a design to the longitudinally extending central surface of said collapsed material, said design appearing vertically along the side of a finished garment.

* * * * *